US011794972B2

(12) United States Patent
Vish

(10) Patent No.: US 11,794,972 B2
(45) Date of Patent: Oct. 24, 2023

(54) STACKABLE CONTAINERS WITH SUPPORT BAND

(71) Applicant: Waddington North America, Inc., Chelmsford, MA (US)

(72) Inventor: Samantha Vish, Denver, CO (US)

(73) Assignee: Waddington North America, Inc., Chelmsford, MA (US)

( * ) Notice: Subject to any disclaimer, the term of this patent is extended or adjusted under 35 U.S.C. 154(b) by 313 days.

(21) Appl. No.: 17/055,889

(22) PCT Filed: May 17, 2019

(86) PCT No.: PCT/US2019/032865

§ 371 (c)(1),
(2) Date: Nov. 16, 2020

(87) PCT Pub. No.: WO2019/222624

PCT Pub. Date: Nov. 21, 2019

(65) Prior Publication Data

US 2021/0188510 A1 Jun. 24, 2021

Related U.S. Application Data

(60) Provisional application No. 62/673,643, filed on May 18, 2018.

(51) Int. Cl.
*B65D 21/036* (2006.01)
*B65D 71/02* (2006.01)
(Continued)

(52) U.S. Cl.
CPC ..... *B65D 71/02* (2013.01); *B65D 21/0217* (2013.01); *B65D 25/282* (2013.01); *B65D 63/18* (2013.01)

(58) Field of Classification Search
CPC ..... B65D 63/18; B65D 63/00; B65D 71/02; B65D 21/0209; B65D 25/30;
(Continued)

(56) References Cited

U.S. PATENT DOCUMENTS 1,204,429 A 11/1916 Griswold
3,240,384 A * 3/1966 Lermer ..... B65D 51/242 220/780
(Continued)

FOREIGN PATENT DOCUMENTS

CN 3633289 4/2007
CN 301920804 5/2012
(Continued)

OTHER PUBLICATIONS

PCT International Search Report and Written Opinion for Appl No. PCT/US2019/032865 dated Aug. 23, 2019, 11 pages.
(Continued)

*Primary Examiner* — Stephen J Castellano
(74) *Attorney, Agent, or Firm* — Nelson Mullins Riley & Scarborough LLP

(57) ABSTRACT

A food carrying system comprises a plurality of food service items including at least one container and optionally one or more plates, drink carriers, and/or trays. At least one of the food service items includes opposing strap openings formed in an edge, encircling flange, or opposed flange handles thereof. A support band encircles the stack, passing through the strap openings, and ends thereof are affixed together to stabilize the stack and in embodiments providing a hand-hold for carrying the stack. The band can further extend through a strap opening provided in a separate handle, so that the stack can be carried using the handle. Strap openings can be provided on lids and/or bases of the containers. Strap openings can be closed ovals, or can be C-shaped, having
(Continued)

open outer edges. Band ends can be joined by adhesive, hook-and-loop, knot tying, stapling, snaps, buttons, etc.

14 Claims, 8 Drawing Sheets

(51) Int. Cl.
*B65D 21/02* (2006.01)
*B65D 25/28* (2006.01)
*B65D 63/18* (2006.01)

(58) Field of Classification Search
CPC ..... B65D 25/282; B65D 25/2832; B65D 25/2888; B65D 25/2894; B65D 21/0217
USPC ..... 220/772, 771, 212.5; 294/149, 152, 167, 294/170, 171
See application file for complete search history.

(56) References Cited

U.S. PATENT DOCUMENTS

| | | | | |
|---|---|---|---|---|
| D212,821 | S | 11/1968 | Benes | |
| 3,851,754 | A | 12/1974 | Jones | |
| 4,890,873 | A | 1/1990 | Prada et al. | |
| D398,812 | S | 9/1998 | Laib | |
| D436,495 | S | 1/2001 | Ferrer | |
| 6,196,406 | B1 | 3/2001 | Ennis | |
| D465,382 | S | 11/2002 | Wolf | |
| D472,759 | S | 4/2003 | Teisen-Simony | |
| D472,767 | S | 4/2003 | Gebhardt | |
| D521,379 | S | 9/2006 | Czebiniak | |
| D529,332 | S | 10/2006 | Hoenstein | |
| D549,519 | S | 8/2007 | Moon | |
| D560,099 | S | 1/2008 | Hatcher | |
| D567,025 | S * | 4/2008 | Claffey | D7/514 |
| D582,201 | S | 12/2008 | Kellermann | |
| D609,530 | S | 2/2010 | Hart | |
| D611,305 | S | 3/2010 | Hart | |
| D615,721 | S | 5/2010 | Martin | |
| D631,703 | S | 2/2011 | Green-Cotton | |
| D633,339 | S | 3/2011 | Hart | |
| D635,820 | S | 4/2011 | Molayem | |
| 8,006,843 | B1 * | 8/2011 | McFarland | B65D 21/0233 206/520 |
| D669,311 | S | 10/2012 | Hsu | |
| D675,057 | S | 1/2013 | Harvey | |
| D677,116 | S | 3/2013 | Smyers | |
| D684,007 | S | 6/2013 | Dagan | |
| D695,575 | S | 12/2013 | Katz | |
| D732,886 | S | 6/2015 | Heiberg | |
| D733,489 | S | 7/2015 | Nelson | |
| D735,524 | S | 8/2015 | Holding | |
| D809,335 | S | 2/2018 | Bouveret | |
| D829,036 | S | 9/2018 | Garcia Luna | |
| D835,456 | S | 12/2018 | Sedgwick | |
| D883,023 | S | 5/2020 | Hollinger | |
| D891,171 | S | 7/2020 | Papet | |
| D897,833 | S | 10/2020 | Vish | |
| D942,265 | S | 2/2022 | Vish | |
| D956,473 | S | 7/2022 | Peterson | |
| 2013/0206784 | A1 | 8/2013 | Short et al. | |
| 2021/0188510 | A1 | 6/2021 | Vish | |

FOREIGN PATENT DOCUMENTS

| | | | |
|---|---|---|---|
| CN | 304522855 | | 3/2018 |
| CN | 102771979 | A | 11/2021 |
| GB | 272714 | A | 6/1927 |
| JP | 2003012025 | A | 1/2003 |
| JP | 2004136950 | A | 5/2004 |
| WO | 2011029009 | A1 | 3/2011 |

OTHER PUBLICATIONS

International Preliminary Report on Patentability for PCT Appl. No. PCT/US2019/032865, dated Nov. 24, 2020, 8 Pages.
Extended European Search Report for Patent Appl. No. 19802720.3 dated Jan. 4, 2022, 12 Pages.
Office Action for U.S. Appl. No. 29/698,137 dated Jun. 9, 2023, 49 pages.
Silver serving tray, posted date not available [retrieved May 11, 2023]. Retrieved from internet, www.christofle.com/us_en/ rectangular-tray-with-handles-43x31cm-malmaison-silver-plat-04200760000101.html (Date: 2023) (Year: 2023).
Serving trays with handles, posted date not available [retrieved May 11, 2023]. Retrieved from internet, www.juliaknightcollection.com/collections/serving-platters-trays-with-handles (Date: 2023) (Year: 2023).
Stainless steel serving tray, posted date not available [retrieved May 11, 2023]. Retrieved from internet, https://www.homedepot.com/p/H ome Roots-Amel i a-14-i n-W-x-1-i n-H-x-18-i n-D-Rectang le-Si lver-Stain less-Steel-Dinnerware-and-Servi ng-Storage-20003885 72/ 319283982?irgwc=1 &cm_mmc=afl-ir—(Date: 2023) (Year: 2023).
Le Creuset stoneware rectangular dish with platter lid, posted Jan. 9, 2017 [retrieved May 24, 2023], Retrieved from internet, https://www.amazon.com/Creuset-Stoneware-Rectangular-Platter-Oyster/dp/B01 N7QKDP2/ref (Date: 2017) (Year: 2017).

* cited by examiner

STACKABLE CONTAINERS WITH SUPPORT BAND

RELATED APPLICATIONS

This application is a national phase application of PCT application No. PCT/US2019/032865 with an international filing date of May 17, 2019. PCT application No. PCT/US2019/032865 claims the benefit of U.S. Provisional Application No. 62/673,643, filed May 18, 2018. Both of these applications are herein incorporated by reference in their entirety for all purposes.

FIELD OF THE INVENTION

The invention relates to food carrying systems, and more particularly, to a food carry system that can be used to transport food away from a location where it is prepared to a remote location for consumption such as a home or hotel room.

BACKGROUND OF THE INVENTION

Plastic containers for holding food and consumer goods are in common use. Oftentimes, such containers are used to convey prepared food to a user by a restaurant or other food service establishment, whereby the food is either consumed by the user at the restaurant, with further assistance by restaurant staff, or carried out by the user in the container(s) for subsequent consumption at home, work, or another location. Typically, containers used for this purpose are referred to as "take-out," "takeaway," or "to-go" containers.

Frequently, a takeout order includes batched meal requests for one or more persons requiring multiple containers and food items to be prepared and transported together. Additionally, dinnerware items such as plates, cutlery, napkins and condiments may also be included for customer convenience. Once an order is complete, the multiple containers and dinnerware items are typically packaged into a paper or plastic carrying bag to assist the user in transporting the various items to the destination where it will be consumed.

It is well recognized by people of ordinary skill in the art that placing multiple containers into a carrying bag while still keeping food containers level to avoid tipping and spillage of food contents can be difficult. In addition, it can be difficult for the customer to remove the containers and dinnerware from the carrying bag without tipping the containers, inadvertently detaching the container lids, and/or spilling the food. Furthermore, paper and plastic carrying bags, when filled with multiple containers and dinnerware items, may be susceptible to breakage and ripping. An additional concern regarding plastic bags is that many communities have banned or are considering banning such items due to ecological concerns, thereby narrowing the options available for food providers.

Therefore, there is a need for a food transporting solution that allows food service providers to better organize multiple containers and ancillary items for takeout and carrying purposes, and enables users to safely and conveniently transport the containers and their contents to a remote location for consumption, without spillage or undue disturbance of the food.

SUMMARY OF THE INVENTION

The present disclosure is directed to a food carrying system that allows food service providers to better organize multiple containers and ancillary items for takeout and carrying purposes, and enables users to safely and conveniently transport the containers and their contents to a remote location for consumption, without spillage or undue disturbance of the food.

The disclosed food carrying system includes a plurality of food containers and/or dinnerware that can be linked together by a ribbon, strip, band, or strap. Each of the food containers can contain the same or different types of food.

According to the present disclosure, at least one of the containers and/or dinnerware items includes a pair of opposing flange handles, each of which includes a strap opening. When the food containers and/or dinnerware items are stacked, a support band can be threaded through the strap openings so that it surrounds the stack. The ends of the band can then be joined together to stabilize the stack. In embodiments, slack in the band provides a hand hold that is useful for carrying the stack. In some embodiments, a hole is provided in the band ends above the joining location, thereby configuring the band ends as a carrying handle for the stack. In other embodiments, a separate handle configured with a strap opening is threaded onto the band. The band openings can be closed or open.

A first general aspect of the present invention is a food carrying system that includes a plurality of stackable food service items, said items including at least one stackable container having a base and a lid, at least one of the food service items including a pair of opposed strap openings, and a support band configured for threading through the strap openings and encircling the food service items when stacked, ends of said band being configured for mutual engagement with each other, thereby enabling said encircled food service items to be maintained in a stack during lifting and transport.

In embodiments, the lid of the stackable container includes a pair of the opposed strap openings.

In any of the above embodiments, the base of the stackable container can include a pair of the opposed strap openings.

In any of the above embodiments, for at least one of the food service items the strap openings can be formed in a surrounding edge thereof.

In any of the above embodiments, for at least one of the food service items the strap openings can be formed in a surrounding flange thereof.

In any of the above embodiments, for at least one of the food service items the strap openings can be formed in opposing flange handles thereof.

In any of the above embodiments, the food service items can further include a dinnerware item. In some of these embodiments, the dinnerware item is a plate. In any of these embodiments, the dinnerware item can be a tray.

In any of the above embodiments, the ends of the support band can include openings configured for mutual alignment when the ends of the band are fixed together, said openings thereby forming a handle useful for carrying the stacked food service items.

Any of the above embodiments can further include a handle, said handle comprising a strap opening through which the support band can be threaded so as to facilitate carrying the stacked food service items.

In any of the above embodiments, at least one of the strap openings can be closed, thereby forming an oval shape.

In any of the above embodiments, at least one of the strap openings can be open on an outer side thereof, thereby forming a C shape.

In any of the above embodiments, at least one of the food service items can not include strap openings.

A second general aspect of the present invention is a method of maintaining and transporting a stack of food service items. The method includes providing a plurality of stackable food service items, said items including at least one stackable container having a base and a lid, at least one of the food service items including a pair of opposed strap openings, arranging the stackable food service items in a stack, encircling the stack of food service items with a support band that passes through the strap openings, fixing ends of the support band together, thereby maintaining the stack of food service items for lifting, and transporting the stack of food service items.

Embodiments further include providing a handle that includes a strap opening, passing the support band through the strap opening of the handle, so that the support band encircles the stacked food service items and passes through the handle, grasping the handle, and lifting the handle, thereby lifting the stack of food service items in preparation for transport thereof.

In any of the above embodiments, encircling the stack of food service items cam include threading the support band through at least some of the strap openings.

In any of the above embodiments, at least one of the strap openings can be open on an outer side thereof, thereby forming a C shape, and wherein encircling the stack of food service items includes inserting the support band into the open outer side of the strap opening thereof.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
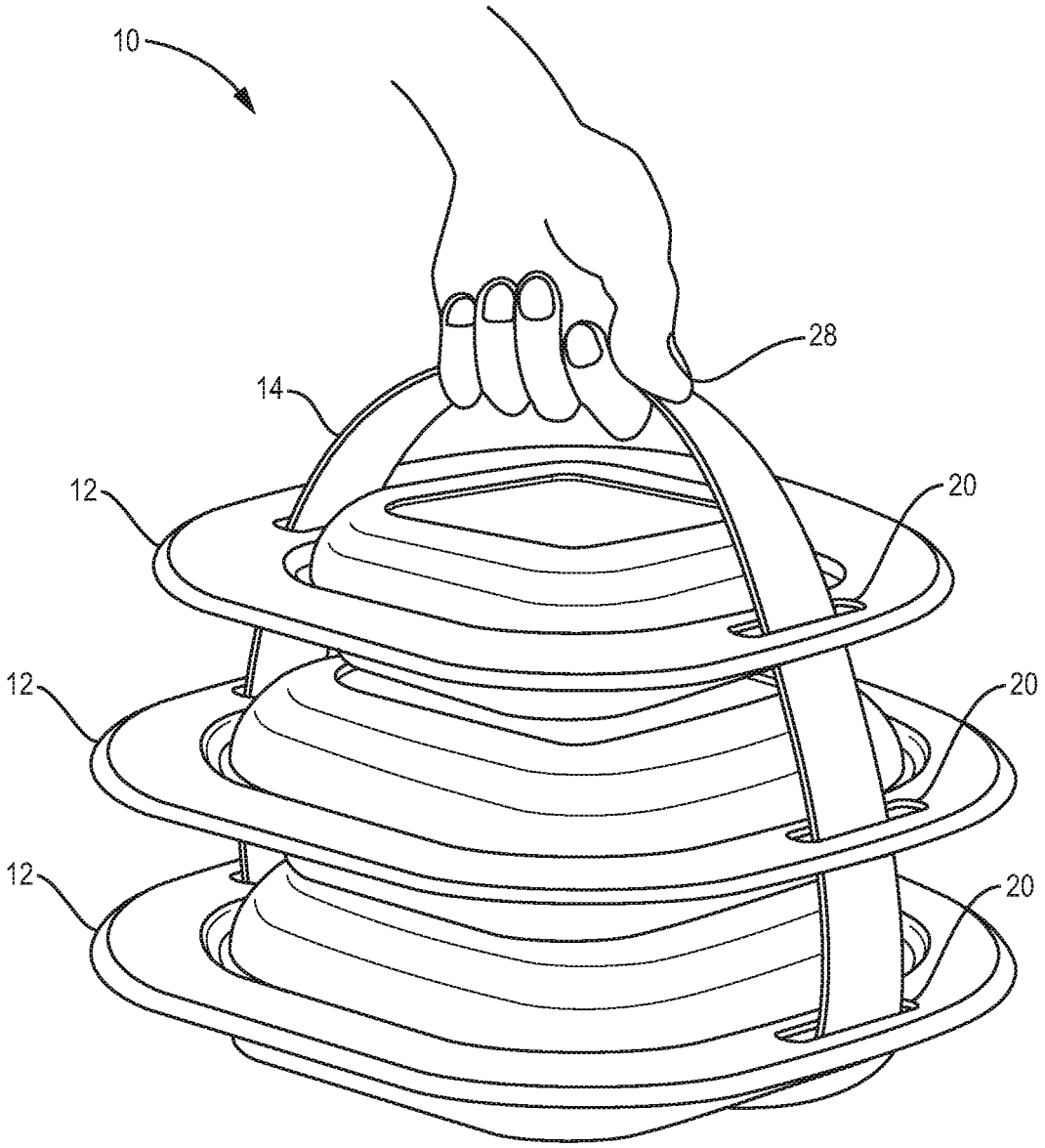
FIG. 1 depicts a food carrying system to of the present disclosure.
Figure 2:
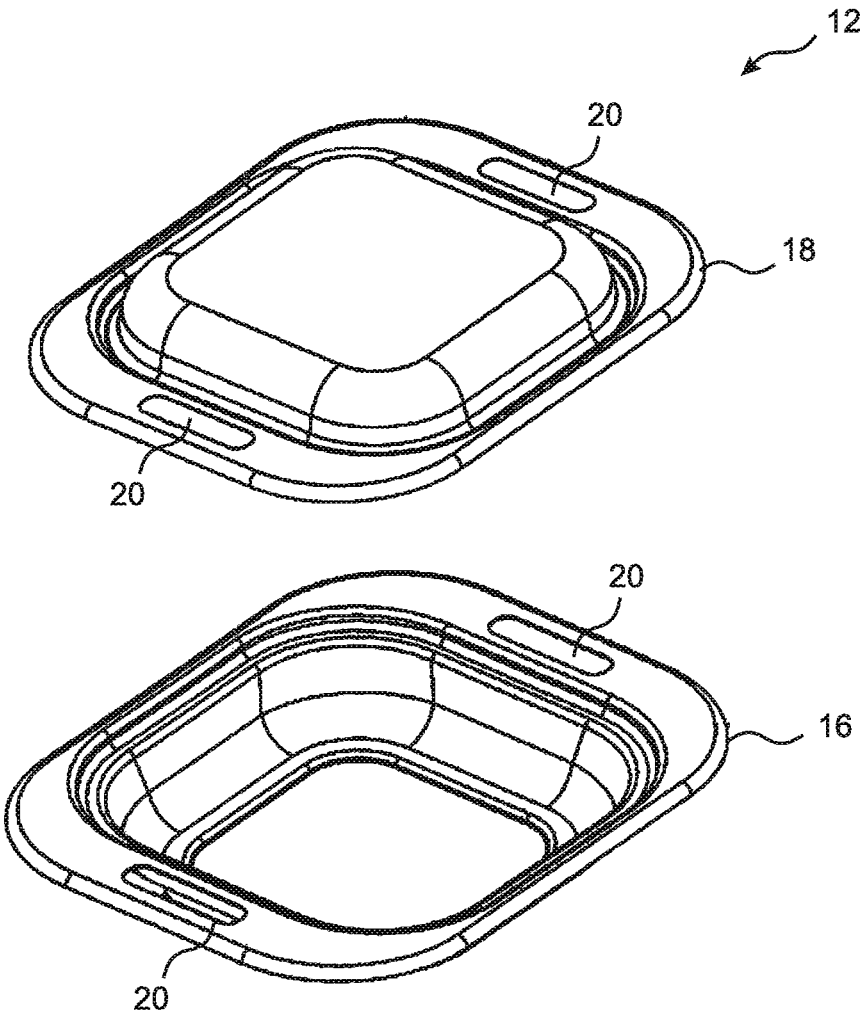
FIG. 2 depicts an exploded view of a food container of the food carrying system of the present disclosure.
Figure 3:
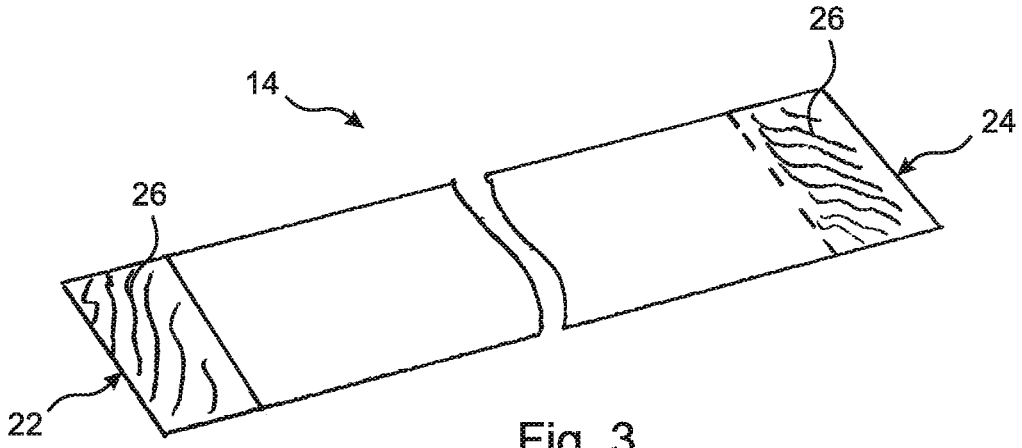
FIG. 3 depicts a support band of the present disclosure.

With reference to the drawing figures, in which like reference designators refer to like elements, there is shown in FIG. 1 a food carrying system 10, including a plurality of food containers 12 in a stacked configuration and connected/linked together by a support band 14. Referring also to FIGS. 2 and 3, each of the food containers 12 can include a base 16 and a lid 18 that are affixable together to contain a food product. Any or all of the bases 16 and 18 can include a pair of strap openings 20 at opposing locations on an outer edge or flange thereof, or in discrete flange handles provided on opposing sides thereof. The band 14 can be threaded through the strap openings 20 and about the plurality of food containers 12, and the ends 22, 24 of the band 14 can be affixed together, thereby encircling the band 14 about the plurality of food containers 12 and stabilizing the stacked configuration shown in FIG. 1. The ends 22, 24 of the band 14 can include an adhesive 26 to join or affix the ends 22, 24 together. The adhesive 26 can be on the same side of the band 14 or on opposite sides of the band. 14. In other embodiments, the ends of the band can be joined by hook-and-loop attachment, by snaps, hooks, buttons, tying of the ends in a knot, or by any other attachment means known in the art.

The encircling of the band 14 about the plurality of food containers 12 can perform the function of sealing or bundling together a selected grouping of food containers 12, and slack in the band can providing a hand hold 28 that is useful for carrying the selected grouping of food containers 12. When the carrying system 10 is lifted the weight of the containers 12 will pull the sides of the band 14 tight against the sides of the stacked containers 12, and slack provided in the band 14 will not substantially reduce the stability of the stack 12 while it is carried.

Figure 4:
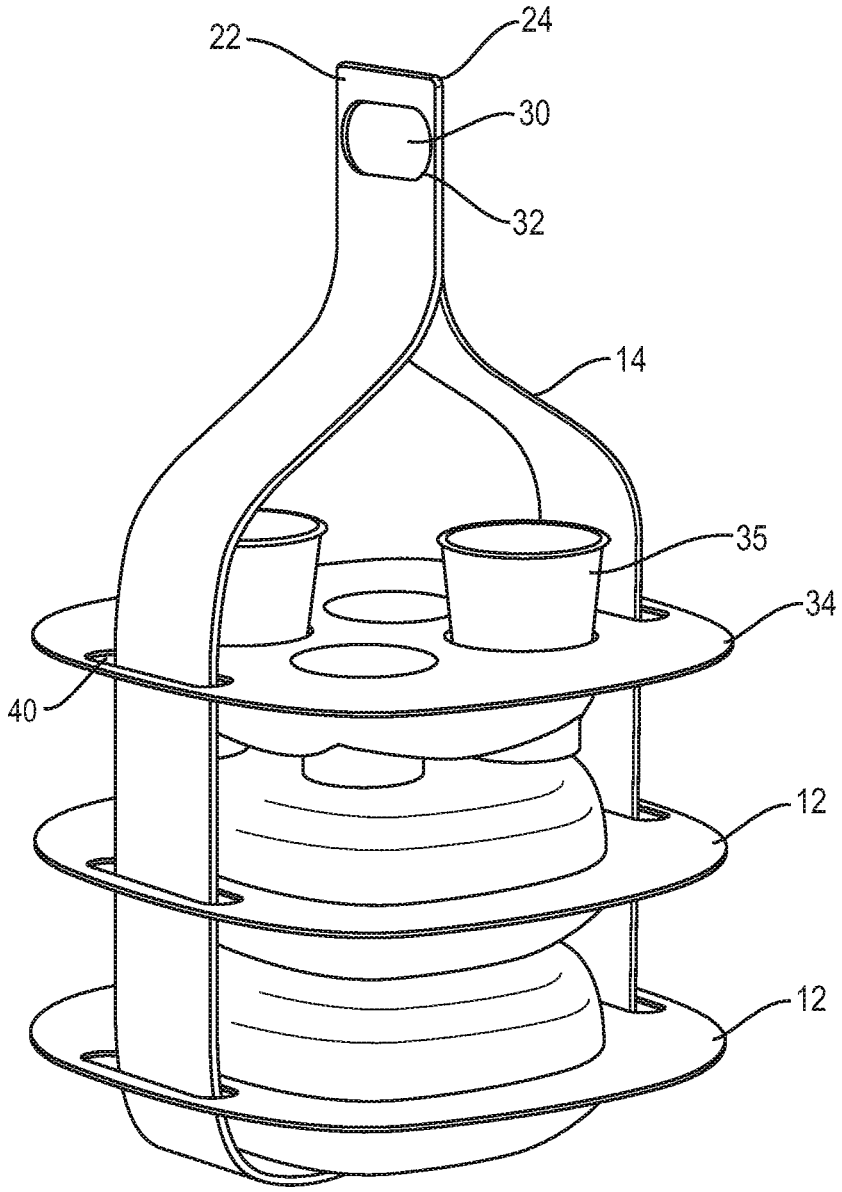
FIG. 4 depicts an alternative food carrying system to of the present disclosure.

Referring to FIG. 4, in an embodiment the ends 22, 24 of the band 14 can each include a through hole 30, wherein the through holes 30 are substantially aligned with each other when the ends 22, 24 of the band 14 are attached together, thus forming a handle 32 for carrying the selected grouping of food containers 12. In similar embodiments, a separate handle configured with a strap opening 20 is threaded onto the band 14.

Figure 5:
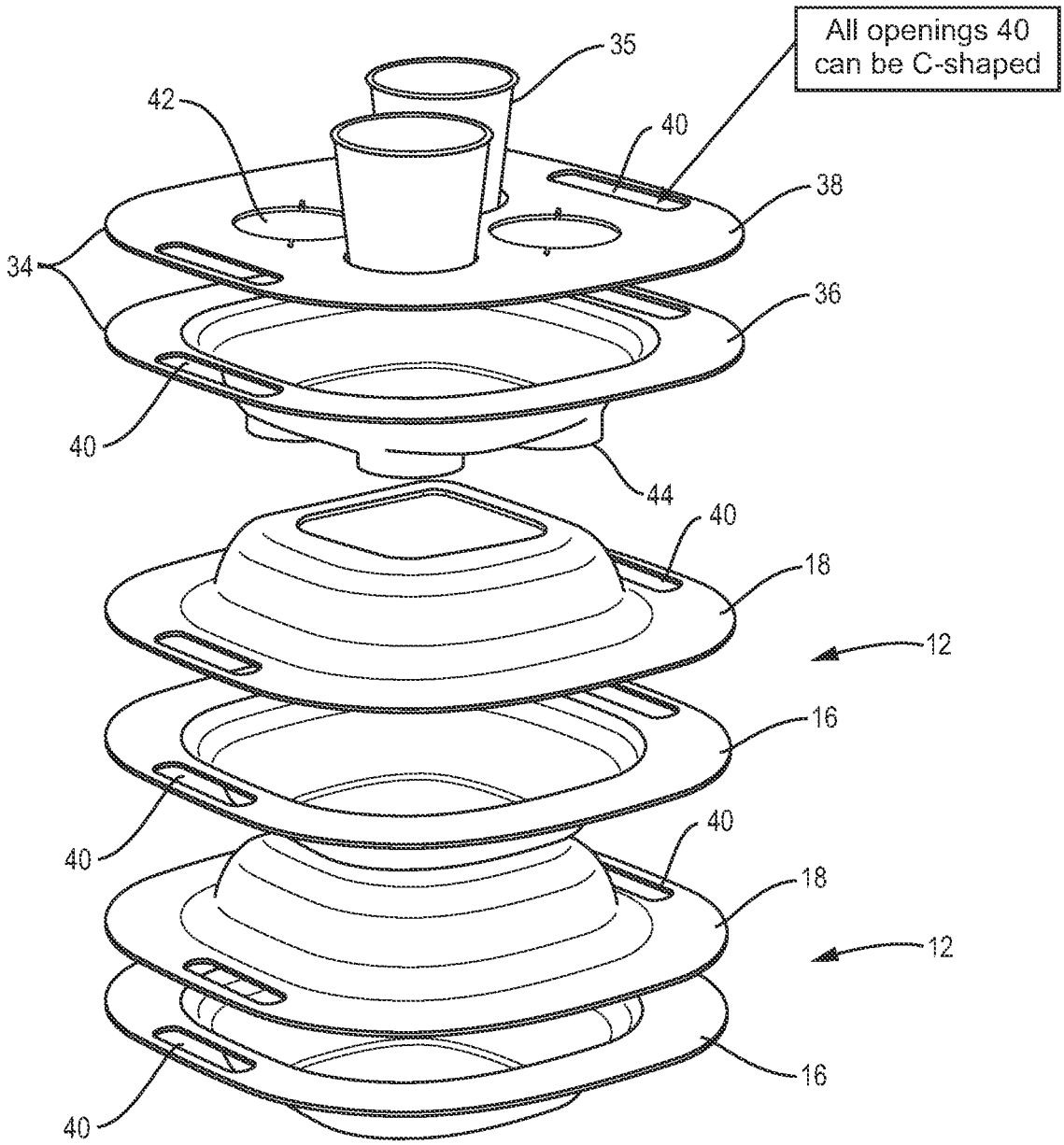
FIG. 5 depicts an exploded view of the food carrying system to of FIG. 4.

Referring to FIGS. 4 and 5, the plurality of containers 12 can include a beverage holder 34 configured for holding one or more drink containers 35, such as cups, cans and the like. The beverage holder 34 can include a base portion 36 and a support portion 38, which are connectable. Each of the base portion 36 and support portion 38 can include strap openings 40 positioned on their outer edges, through which the band 14 can be threaded. The support portion 38 can include a plurality of cutouts 42, though which a drink container 35 can be positioned. The base portion 36 can include a plurality of indented sections 44, which are aligned with the cutouts 42 in the support portion 36, and are configured to receive an end of the drink container 35. In this manner, the combination of the cutouts 42 and indented portions 44 function to secure the drink container 35 in the beverage holder 34. In use, the beverage holder 34 can be positioned on the top of a stack of food containers 12, whereby the band 14 is threaded through and about the stacked food containers 12 and beverage holder 34. The ends 22, 24 of the band 14 are affixed together, locking the band 14 about the stacked food containers 12 and the beverage holder 34.

Figure 6:
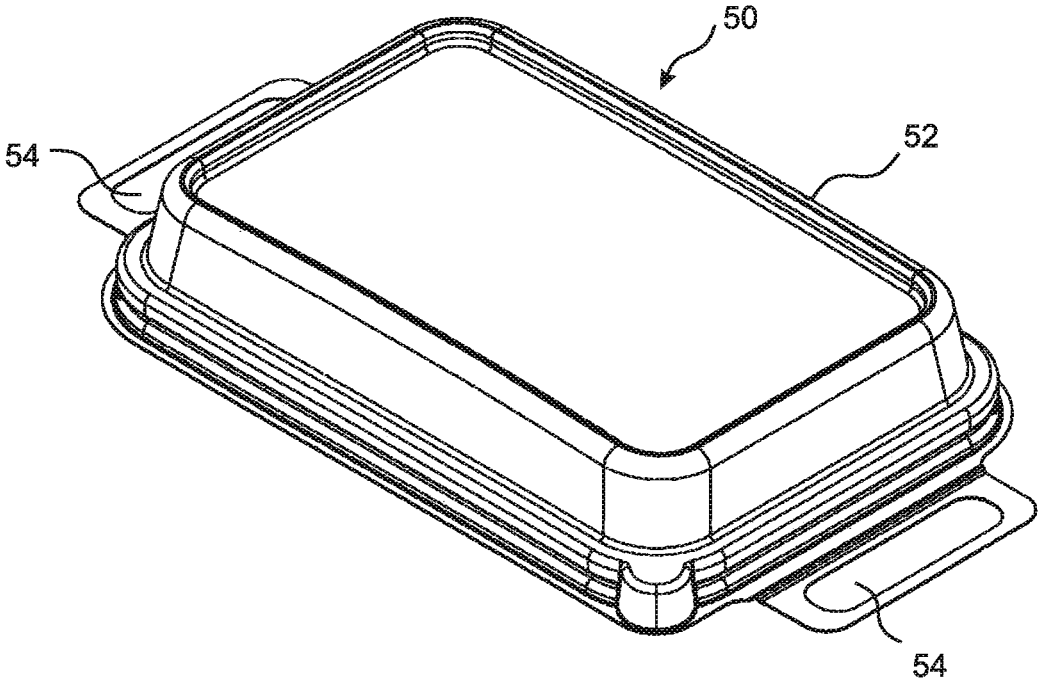
FIG. 6 depicts a lid for a food container of the present disclosure.

With reference to FIG. 6, in an alternate embodiment food container 50 is provided, where the container 50 includes a base (not shown) and a lid 52 that can be affixed together to contain a food product. The lid 52 of food container 50 can include a pair of strap openings 54, on opposite sides of the lid 52. A plurality of the food containers 50 can be linked into a stack 10 by threading a band 14 through the strap openings 54 and about the plurality of food containers 50, and affixing the ends 22, 24 of the band 14 together so that the band 14 encircles the plurality of food containers 50. In this embodiment, the bases of the containers 50 do not include strap openings. However, in similar embodiments the bases can include strap openings that are co-aligned with openings 54.

Figure 7:
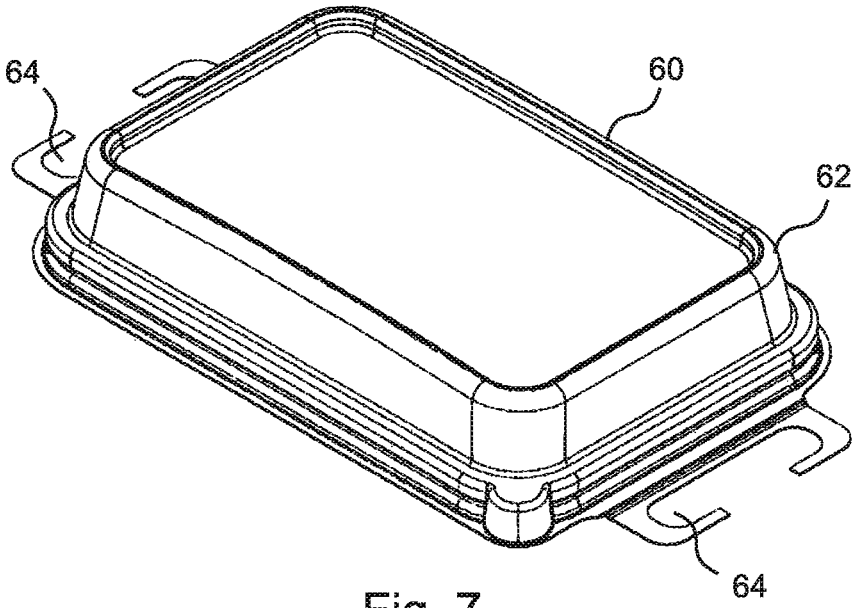
FIG. 7 depicts an alternative lid for a food container of the present disclosure.

With reference to FIG. 7, in yet another embodiment food container 60 is substantially similar to food container 50, except that the strap openings 64 are open at their outer edges, substantially forming a "C-shape" rather than a closed oval. As in the embodiment of FIG. 6, the embodiment of FIG. 7 includes a base (not shown) and a lid 62 that are affixable together to contain a food product. The strap openings 64 that are provided on opposite sides of the lid 62 can be utilized to link a plurality of food containers 60 together by threading a band 14 through the strap openings 64 and about the plurality of food containers 60 and affixing the ends 22, 24 of the band 14 together, thereby encircling the band 14 about the plurality of food containers 60.

The embodiment of FIG. 7 further allows the strap to be installed, and for containers to be subsequently added, removed, and or exchanged in the stack, without a need to unthread and re-thread the band 14 sequentially through the strap openings 64. Instead, the strap 14 can be simply installed and withdrawn from the strap openings 64 through the outer open edges of the strap openings 64.

In the embodiment of FIG. 7, the base of the container does not include corresponding openings. However, in similar embodiments the base can include strap openings that are similar in position and structure to strap openings 64.

Figure 8:
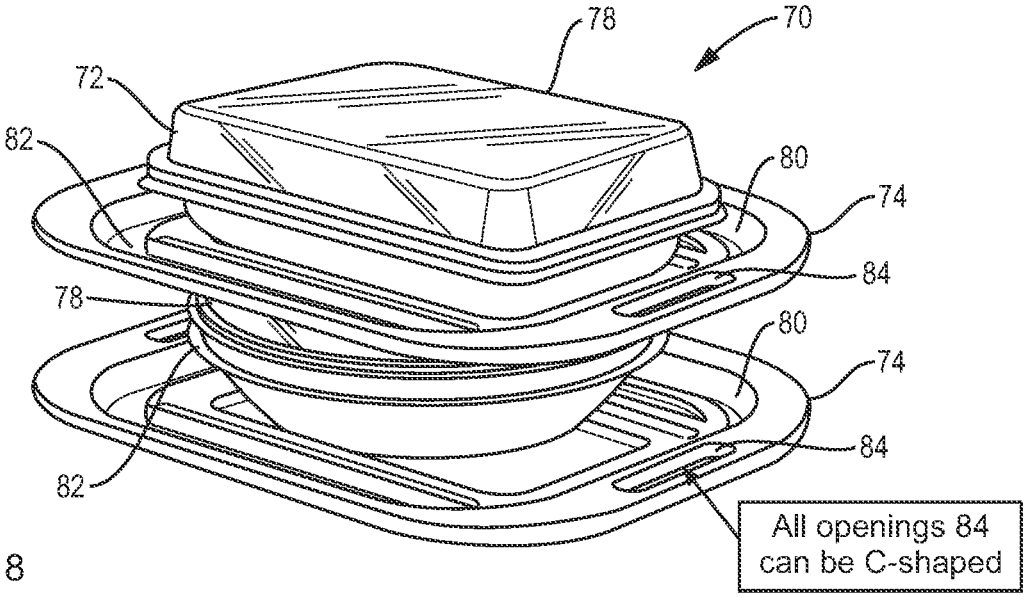
FIG. 8 depicts an alternative food carrying system of the present disclosure.
Figure 9:
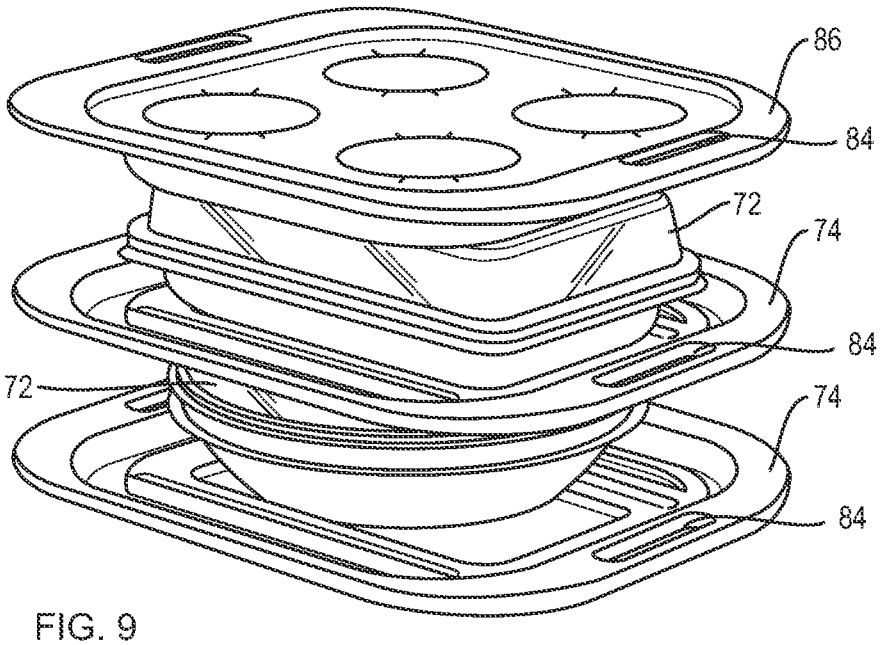
FIG. 9 depicts an alternative food carrying system of the present disclosure.
Figure 10:
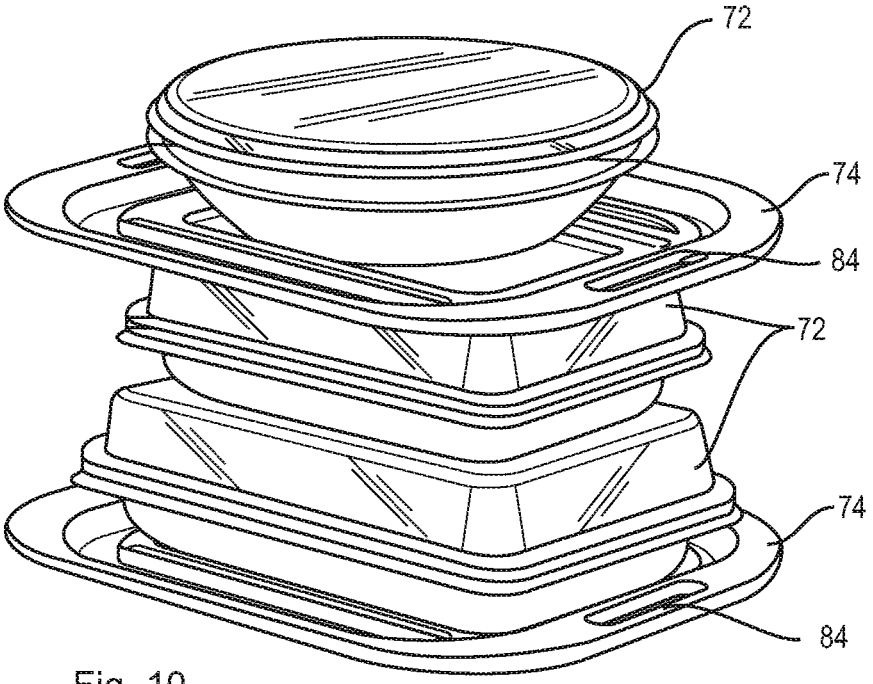
FIG. 10 depicts an alternative food carrying system of the present disclosure.
Figure 11:
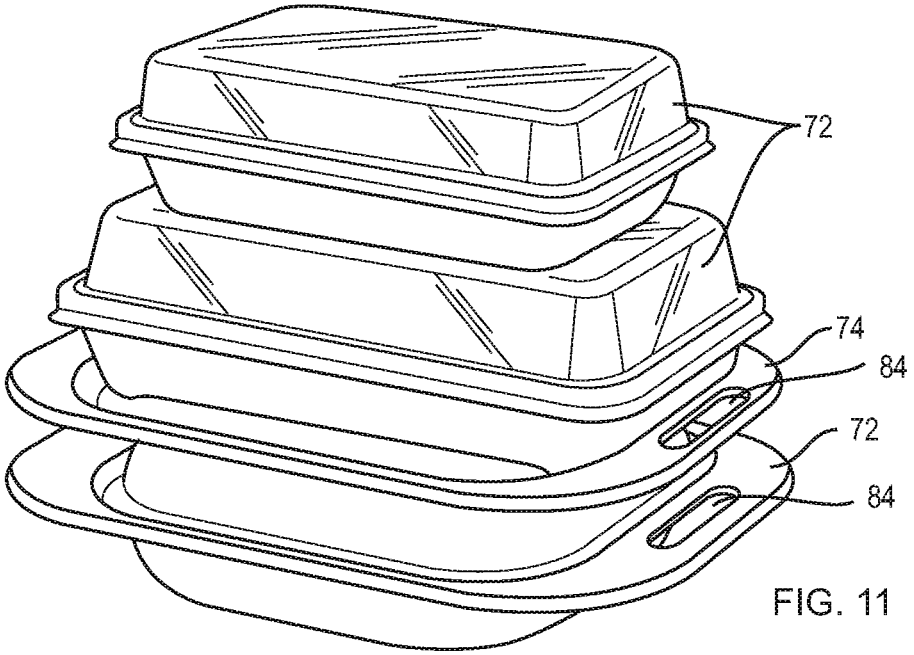
FIG. 11 depicts an alternative food carrying system of the present disclosure.
Figure 12:
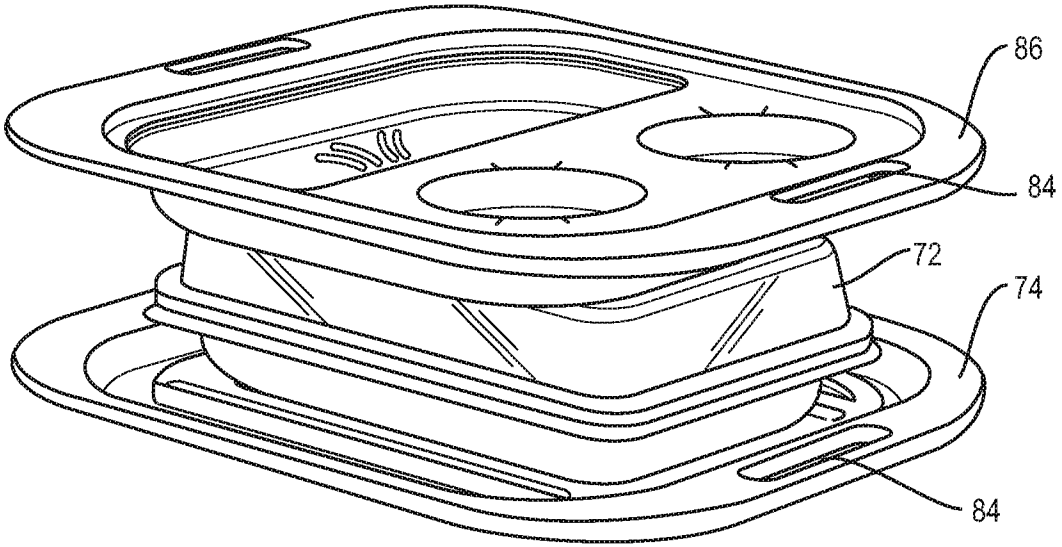
FIG. 12 depicts an alternative food carrying system of the present disclosure.

Referring to FIG. 8, in an alternative embodiment, the food carrying system 70 includes combinations of one or more food containers 72 and dinnerware items 74. Each of the food containers 72 can include a lid 78 and base 80 affixable together to contain a food product. Each of the dinnerware items 74 can include a base portion 82 and a pair of strap openings 84 positioned on opposite sides of the dinnerware items 74. The food containers 72 and dinnerware items 74 can be positioned/stacked in an alternating arrangement, such that band 14 can be threaded through the strap openings 84 in the dinnerware items 74 and positioned about the stacked food containers 72, where the ends 22, 24 of the band 14 can be affixed together, thereby encircling the stacked food containers 72 and dinnerware items 74 and locking the band 14 about the stacked food containers 72 and dinnerware items 74. The locking of the band 14 about the stacked food containers 72 and dinnerware items 74 can perform the function of sealing together the stacked food containers 72 and dinnerware items 74, as well as providing a hand hold 28 for carrying the stacked food containers 72 and dinnerware items 74 (similar to the arrangement shown in FIG. 1). Strap openings 84 may be configured with openings at their outer edges, substantially forming a "C-shape". Dinnerware items 74 may consist of one or more types such as plates, trays, or bowls.

FIGS. 9-12 illustrate alternative stacking configurations, including food containers 72, dinnerware items 74, and beverage holders 86. It is noted that these are not the only configurations included within the scope of the present disclosure, and that all alternative configurations are included in the disclosure that allow for a band 14 to be threaded through strap openings 84 to secure together a stacking of food containers 72, dinnerware items 74, and/or beverage holder 86, as well as providing a hand hold for carrying such.

In the embodiments of FIGS. 8-12, it is noted that the food containers 72 do not include strap openings for receiving the band 14. Instead, only the dinnerware items (trays) 74 and beverage holders 86 include strap openings 84, and these secure the band 14. In similar embodiments, the food containers 72 also include strap openings as discussed above.

In the above noted embodiments, the food containers 72, dinnerware items 74, and beverage holders 34 may be of a variety of shapes, sizes, configurations, and may be constructed from materials such as paper, plastic, foam, bagasse, laminated materials, compostable materials, biodegradable materials, bioplastics, recycled materials, and/or plastic blends and compounds. The lids and bases may also be constructed of different materials, such as a clear plastic lid and a bagasse base.

In any of the above embodiments the band 14 may be constructed of paper, plastic, bagasse, laminated materials, compostable materials, biodegradable materials, non-wovens, recycled materials, and or composites thereof. The band may be made in a variety of configurations with varying length, width, and thickness according to the design of the container handles. The ends of band 14 may be affixed together by a variety of techniques known in the art including knot tying, snaps, buttons, adhesives, hook and loop material, stapling, and/or other fastening methods.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A food carrying system comprising:

a plurality of stackable food service items configured for stacking in a vertical stacking direction, a first of the stackable food service items including a pair of opposed strap openings formed in and penetrating vertically through one or more outwardly extending horizontal flanges or handles thereof, the opposed strap openings and the outwardly extending horizontal flanges or handles lying in a substantially horizontal plane that is perpendicular to the vertical stacking direction, each of said strap openings being formed by a pair of fingers that extend in the horizontal plane from the respective flange or handle to partially surround a central region of the strap opening, symmetrically opposed ends of the fingers defining and being separated by a gap therebetween, such that the strap opening is open on an outward side thereof, said gap being substantially parallel to but shorter than a length of the central region of the strap opening, causing the strap opening to be C-shaped; and a flexible support band configured for encircling all of the food service items when stacked, ends of said flexible support band being configured for mutual engagement with each other, thereby enabling said encircled food service items to be maintained in a stack during lifting and transport, the flexible support band being configured for horizontal insertion into the central portions of the strap openings of the first stackable food service item through the gaps in the strap openings, without disengaging the ends of the flexible support strap from each other.

2. The food carrying system of claim 1, wherein the pair of opposed strap openings are formed in a lid of the first stackable food service item.

3. The food carrying system of claim 1, wherein the pair of opposed strap openings are formed in a base of the first stackable food service item.

4. The food carrying system of claim 1, wherein the one or more outwardly extending horizontal flanges or handles is a surrounding edge of the first stackable food service item.

5. The food carrying system of claim 1, wherein the one or more outwardly extending horizontal flanges or handles is a surrounding flange of the first stackable food service item.

6. The food carrying system of claim 1, wherein the outwardly extending horizontal flanges or handles are a pair of opposing flange handles of the first stackable food service item.

7. The food carrying system of claim 1, wherein the stackable food service items include a dinnerware item.

8. The food carrying system of claim 7, wherein the dinnerware item is a plate.

9. The food carrying system of claim 7, wherein the dinnerware item is a tray.

10. The food carrying system of claim 1, wherein the ends of the flexible support band include band openings configured for mutual alignment when the ends of the flexible support band are mutually engaged with each other, said band openings being useful for carrying the stacked food service items.

11. The food carrying system of claim 1, wherein a second of the stackable food service items does not include strap openings.

12. The food carrying system of claim 1, wherein for each of the C-shaped strap openings of the first food service item, a gap length of the gap between the symmetrically opposed ends of the fingers that partially surround the central region of the strap opening is at least approximately one quarter as long as the length of the central region of the strap opening.

13. A method of maintaining and transporting a stack of food service items, the method comprising:

providing the food carrying system according to claim 1;

arranging the stackable food service items in a stack;

encircling the stack of food service items with the flexible support band and engaging the ends of the flexible support band with each other;

passing the flexible support band horizontally through the gaps of the strap openings and into the central regions of the strap openings of the first stackable food service item without disengaging the ends of the flexible support band from each other, thereby maintaining the stack of stackable food service items in the stack; and transporting the stack of stackable food service items by lifting the mutually engaged ends of the flexible support band.

14. The method of claim 13, wherein the ends of the flexible support band include band openings, and the method further comprises:

mutually aligning the band openings when the ends of the flexible support band are engaged with each other;

inserting at least one finger through the aligned band openings; and pulling upward on the aligned band openings, thereby lifting the stack of stackable food service items in preparation for transport thereof.

* * * * *